US006782114B2

(12) United States Patent
Ando et al.

(10) Patent No.: US 6,782,114 B2
(45) Date of Patent: Aug. 24, 2004

(54) LOUDSPEAKER

(75) Inventors: Tomiaki Ando, Yamagata-ken (JP); Takashi Suzuki, Yamagata-ken (JP)

(73) Assignees: Pioneer Corporation, Tokyo (JP); Tohoku Pioneer Corporation, Yamagata-Ken (JP)

( * ) Notice: Subject to any disclaimer, the term of this patent is extended or adjusted under 35 U.S.C. 154(b) by 0 days.

(21) Appl. No.: 10/247,341

(22) Filed: Sep. 20, 2002

(65) Prior Publication Data

US 2003/0063769 A1 Apr. 3, 2003

(30) Foreign Application Priority Data

Oct. 1, 2001 (JP) ..... 2001-304862

(51) Int. Cl.[7] ..... H04R 25/00

(52) U.S. Cl. ..... 381/398; 381/386; 381/423; 181/171

(58) Field of Search ..... 381/386, 391, 381/395, 398, 423, 424, 432, 430; 181/171, 172, 199, 173

(56) References Cited

U.S. PATENT DOCUMENTS 5,115,474 A * 5/1992 Tsuchiya et al. ..... 381/398
6,176,345 B1 * 1/2001 Perkins et al. ..... 381/398
6,305,491 B2 * 10/2001 Iwasa et al. ..... 181/172

* cited by examiner

*Primary Examiner*—Huyen Le
(74) *Attorney, Agent, or Firm*—Arent Fox PLLC

(57) ABSTRACT

An outer end portion 21A of an edge 21, which is formed at an interior of an outer periphery thereof, is mounted on an attaching surface 10*b* which is formed inside an outer peripheral rim 10*a* of a speaker frame 10. An outer peripheral surface 21*a* of the outer end portion 21A is allowed to abut on the outer peripheral rim 10*a* of the speaker frame 10. Also, an attaching screw section 14 of the speaker frame is provided on the attaching surface 10*b*. The outer end portion 21A has a wall thickness thicker than the thickness of a screw head of the attaching screw section, and is provided with a notch 21*b* to avoid the attaching screw section 14. Therefore, the inside area of the speaker frame can be effectively utilized to obtain enough level of outputted sound pressure. Further, since a gasket is unnecessary for positioning and attaching the edge, the number of parts can be reduced to lead cost-down.

5 Claims, 4 Drawing Sheets

LOUDSPEAKER

BACKGROUND OF THE INVENTION

1. Field of the Invention

The present invention relates to a loudspeaker used as audio equipment, in particular to a loudspeaker having an edge at an outer periphery of a diaphragm, wherein an outer end of the edge is attached on an attaching surface which is formed at the inside of an outer peripheral rim of a speaker frame.

The present application claims priority from Japanese Application No. 2001-304862, the disclosure of which is incorporated herein by reference for all purposes.

2. Description of the Related Art

A conventional loudspeaker for reproducing music or the like has a basic structure as shown in FIG. 4. FIG. 4*a* is a top plan view, and FIG. 4*b* is a sectional view taken along a line x—x of FIG. 4*a*. In FIGS. 4*a* and 4*b*, a magnetic circuit 1 comprises a magnet 2, a lower plate 3, and an upper plate 4. In the magnetic circuit 1, a gap between magnetic poles is formed between the upper plate 4 and a center pole 5 which stands straight from a center position of the lower plate 3. A coil bobbin 6 which sets a voice coil 7 by winding is located so as to arrange the voice coil 7 within the gap between the magnetic poles. A center cap 8 is mounted upon an upper end of the coil bobbin 6. At the vicinity of the upper end of the coil bobbin 6, a center portion of a diaphragm 9 is fixed. An annular edge 12 is connected with an outer periphery of the diaphragm 9. The diaphragm 9 is attached on an upper portion of a speaker frame 10, which is provided on the upper plate 4, through the edge 12.

On the upper portion of the speaker frame 10 is formed an outer peripheral rim 10*a*, which has an attaching surface 10*b* inside it. At the outer end of the edge 12 is formed an outer end portion 12*a*, which is mounted on the attaching surface 10*b* as a part of the speaker frame 10. The outer end portion 12*a* is pressed down onto the attaching surface 10*b* by a gasket 13, which is also attached onto the attaching surface 10*b*, so as to be airtightly attached onto the attaching surface 10*b*.

In addition, one end of a damper 11 is connected with the coil bobbin 6, and the other end thereof is supported by a damper supporting section 11*a*, which is connected with the speaker frame 10, so that the voice coil 7 can be accurately held within the gap between the magnetic poles of the magnetic circuit 1.

In such a configured loudspeaker, the coil bobbin 6 is oscillated according to driving signals supplied to the voice coil 7. The diaphragm 9, which is supported by the damper 11 and the edge 12 having a function of suspension, is oscillated by the oscillation of the coil bobbin 6, thereby reproducing sound based on sound signals supplied to the voice coil 7.

In the conventional loudspeaker as mentioned above, an attaching screw section 14 for attaching the speaker frame 10 onto a baffle plate or the other housing is formed on the attaching surface 10*b* of the speaker frame 10. The gasket 13 has a notch 13*a* which corresponds to the attaching screw section 14. An outer peripheral surface of the gasket 13 is abutted to an inside of the outer peripheral rim 10*a* of the speaker frame 10, thereby positioning the edge 12 which is fixed by the gasket 13.

According to such a structure of the speaker, a size of the speaker frame 10 can be set by making the best use of a speaker setting area on a baffle plate or the other housing since the attaching screw section 14 is provided inside the outer peripheral rim 10*a* of the speaker frame 10. However, since the gasket 13 is provided inside the outer peripheral rim 10*a* of the speaker frame 10 to fix the edge 12, an outer diameter L' formed by the edge 12 and the diaphragm 9 is restricted by a width of the gasket 13. As a result, an inside area of the speaker frame 10 can not be effectively utilized as an oscillation area formed by the diaphragm 9 or the like. In other words, since an outputted sound pressure level of the speaker is in the relation of function with the oscillation area, the conventional structure of loudspeaker has any problem that it is difficult to obtain the enough level of the outputted sound pressure which corresponds to the inside area of the speaker frame 10.

Further, since the gasket 13 is used for positioning and fixing the outer end of the edge 12 in this case, the number of parts are increased to cause a cost-up.

SUMMARY OF THE INVENTION

The present invention has been proposed in order to settle the above-mentioned problems. An object of the present invention is to provide a loudspeaker which can obtain an enough level of outputted sound pressure by means of effectively utilizing the inside area of the speaker frame as the oscillation area, and which can reduce the number of parts by the non-use of gasket.

According to the first aspect of the present invention, there is provided a loudspeaker comprising an edge at an outer periphery of a diaphragm, in which an outer end portion of the edge is attached upon an attaching surface formed at an inside of an outer peripheral rim of a speaker frame, wherein the outer end portion is formed with a direction to the inside from the outer most periphery of the edge, and has an outer periphery surface which is allowed to abut on the outer peripheral rim of the speaker frame.

According to the second aspect of the present invention, there is provided a speaker including the first aspect, further comprising an attaching screw section of the speaker frame provided on the attaching surface, wherein the outer end portion has a thicker wall portion than a thickness of a screw head of the attaching screw section, and a notch for avoiding the attaching screw section.

According to such a construction, the present invention performs the following function.

According to the first aspect of the present invention, the outer end portion, which is provided at an outer end of the edge, is formed with a direction to the inside from the outer most periphery of the edge, and is attached onto the attaching surface of the speaker frame. Thus, the outer periphery of the edge is allowed to approach the outer peripheral rim of the speaker frame as much as possible, thereby enlarging an outer diameter composed of the diaphragm and the edge to the maximum of the speaker frame. Consequently, the inside area of the speaker frame is effectively utilized as the oscillation area, so that enough level of outputted sound pressure can be secured.

In addition, since the outer peripheral surface of the outer end portion of the edge is allowed to abut on the outer peripheral rim of the speaker frame to perform the positioning of the edge, the positioning according to a gasket is unnecessary, and then the number of parts can be reduced.

According to the second aspect, in addition to the above function, a size of the speaker frame can be set largely by making the best use of a speaker setting area on a baffle plate or the other housing since the attaching screw section is provided inside the outer peripheral rim of the speaker frame. Further, the inside area of the speaker frame can be effectively utilized as the oscillation area.

Also, since the outer end portion formed at the outer end of the edge has a wall thickness thicker than the screw head of the attaching screw section, and the notch formed for avoiding the attaching screw section, the attaching screw can be prevented from exerting influence to the oscillation of the edge. In addition, according to the desired wall thickness of the outer end portion of the edge, the outer end portion can be bonded onto the attaching surface of the speaker frame, so that the same airtightness as one of gasket can be secured.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENT

Figure 1A:
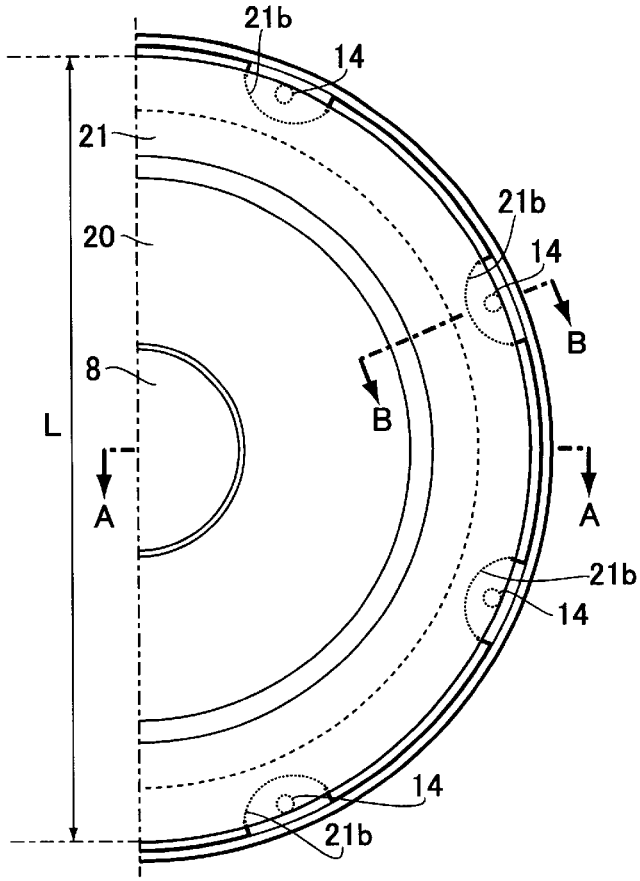
FIG. 1*a* is a top plan view for showing a construction of a loudspeaker according to one embodiment of the present invention.
Figure 1B:
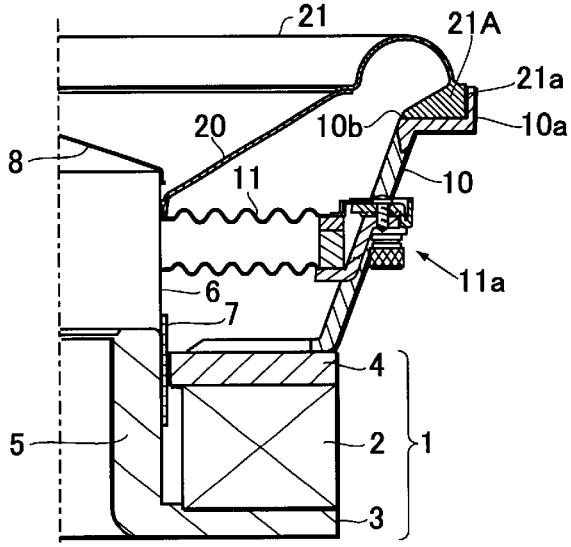
FIG. 1*b* is a sectional view as taken along a line A—A of FIG. 1*a;*

Hereinafter, an embodiment of the present invention will be explained referring to the drawings. The same reference numerals will be used to the same portion as one of the conventional example to omit the same explanation. FIG. 1*a* is a top plan view as an explanatory view for showing a construction of a loudspeaker according to an embodiment of the present invention. FIG. 1*b* is a sectional view taken along a line A—A of FIG. 1*a*.

In this embodiment, a center portion of a diaphragm 20 is fixed at the vicinity of an upper end of a coil bobbin 6, while an outer periphery of the diaphragm 20 is connected with an annular edge 21. At an outer end of the edge 21 is formed an outer end portion 21A for attaching the outer end of edge upon an attaching surface 10*b*, which is formed at an inside of an outer peripheral rim 10*a* of a speaker frame 10.

The outer end portion 21A is integrally formed with the edge 21 by a pressurized forming of, for example, urethane or rubber, and has a desired wall thickness, wherein it is formed with a direction to the inside from the outer most periphery of the edge 21. A depth surface of the outer end portion 21A is bonded onto the attaching surface 10*b* of the speaker frame 10, and an outer peripheral surface 21*a* thereof abuts on the inside of the outer peripheral rim 10*a* of the speaker frame 10.

According to such a construction, the outer periphery of the edge 21 can be provided adjacently to the outer peripheral rim 10*a* of the speaker frame 10, thereby enlarging an outer diameter L formed by the diaphragm 20 and the edge 21 until the superior limit. Thus, since an area within the speaker frame 10 can be effectively utilized as an oscillation area, a higher level of outputted sound pressure can be obtained.

In addition, the positioning of the edge 21 is performed by making the outer peripheral surface 21*a* of the outer end portion 21A abut against the outer peripheral rim 10*a* of the speaker frame 10, thereby omitting the gasket for the positioning, so that the number of parts can be reduced.

Figure 2:
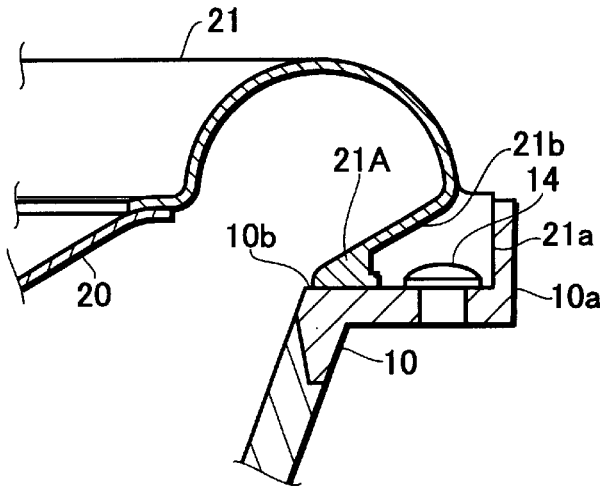
FIG. 2 is a sectional view as taken along a line B—B of FIG. 1*a;*

FIG. 2 is a sectional view taken along a line B—B of FIG. 1. In this embodiment also, the attaching screw section 14 is provided upon the attaching surface 10*b*, which is inside the outer peripheral rim 10*a* of the speaker frame 10, like a conventional speaker. Then, in order to prevent the screw from exerting influence to an oscillation portion of the edge 21, the wall thickness of the outer end portion 21A is made to be thicker than the screw head of the attaching screw section 14, and also a notch 21*b* is formed so as to keep the attaching screw section 14 away from the outer end portion 21A.

According to this structure, a size of the speaker frame 10 can be set largely by making the best use of a speaker setting area on a baffle plate or the other housing since the attaching screw section 14 is provided inside the outer peripheral rim 10*a* of the speaker frame 10. Additionally, as the result, the inside area of the speaker frame 10 can be effectively utilized as the oscillation area formed by the outer diameter L comprising the edge 21 and the diaphragm 20.

Further, since the outer end portion 21A of the edge 21 has the desired wall thickness, a depth surface of the outer end portion 21A can be bonded to the attaching surface 10*b* of the speaker frame 10 including vicinities of the notch 21*b*, so that the same airtightness as one of gasket can be secured.

Figure 3:
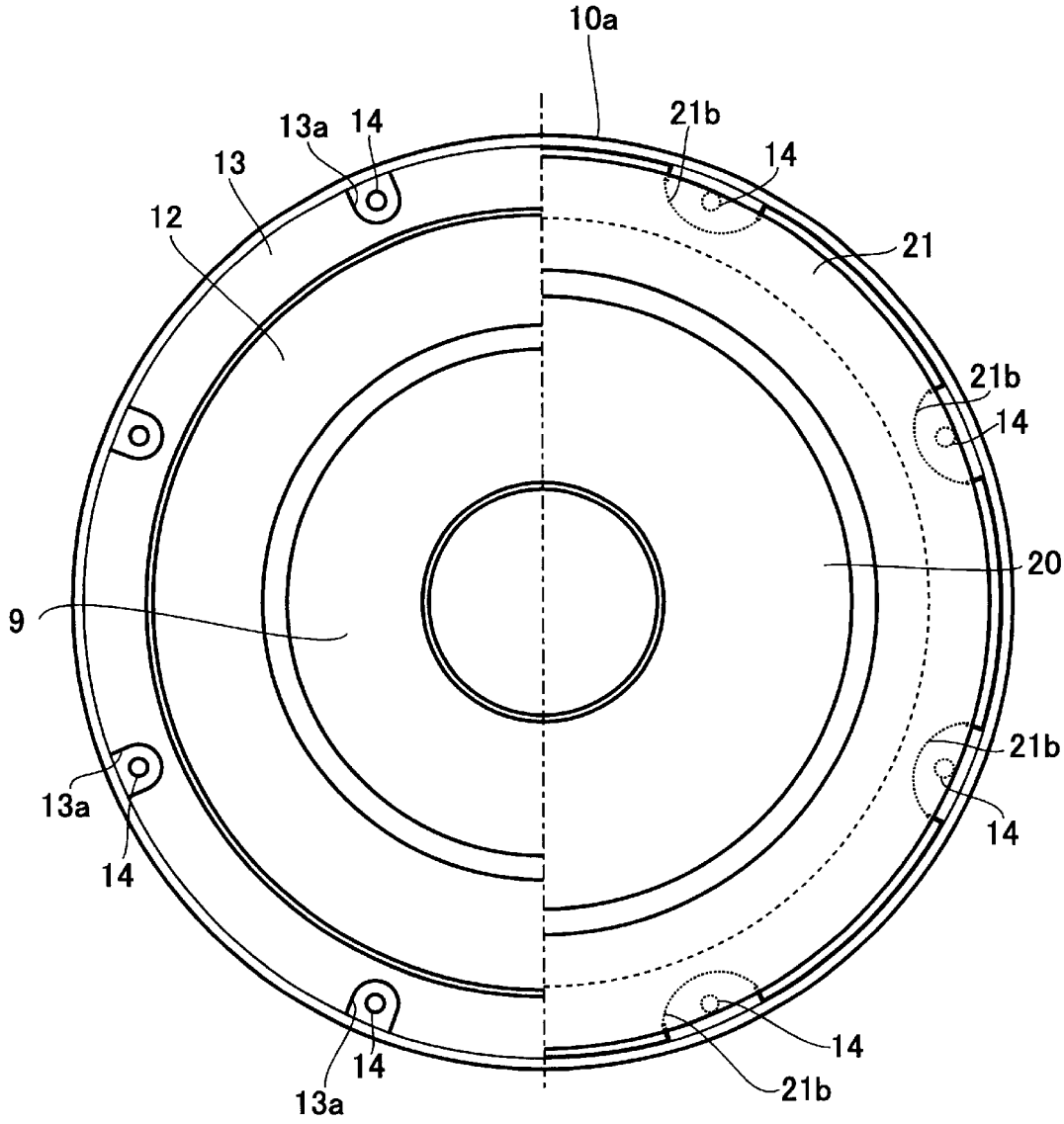
FIG. 3 is an explanatory view for comparing the embodiment of the present invention with the conventional loudspeaker.
Figure 4A:
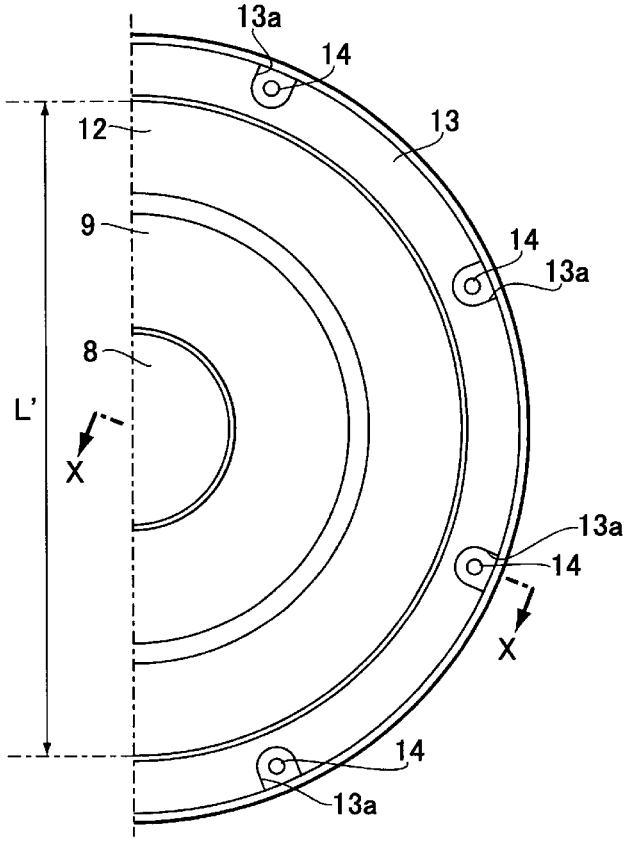
FIG.4 a PRIOR ART
FIG. 4*a* is a top plan view of the conventional speaker.
Figure 4B:
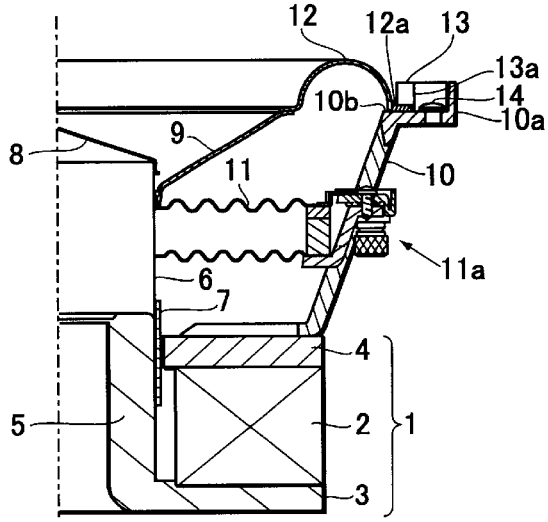
FIG.4 b PRIOR ART
FIG. 4*b* is a sectional view as taken along a line x—x of FIG. 4*a*.

FIG. 3 is an explanatory view for comparing the embodiment of the present invention with the conventional speaker. In this figure, it is assumed that each diameter of the voice coil 7 is the same between the both as well as one of the speaker frame 10, and also the width of the edge 12 is the same as the edge 21, wherein the left side view shows the conventional speaker, and the right side view does the present embodiment. As clearly seen from the figure, the diameter of the diaphragm 20 in the present embodiment is set more largely than one of the diaphragm 9 in the conventional speaker. In short, the present embodiment can obtain much larger oscillation area, namely, higher level of outputted sound pressure than the conventional speaker.

While the invention has been described in conjunction with preferred specific embodiment thereof, it will be understood that this description is intended to illustrate and not limit the scope of the invention, which is defined by the following claims.

What is claimed is:

1. A loudspeaker comprising:

a diaphragm;

an edge attached to an outer periphery of the diaphragm; and a speaker frame, wherein an outer end portion of the edge is attached upon an attaching surface formed at an inside of an outer peripheral rim of the speaker frame, the outer end portion of the edge being inwardly tapered from an outer peripheral surface of the edge, wherein the outer peripheral surface is allowed to abut on the outer peripheral rim of the speaker frame to perform positioning of the edge.

2. The loudspeaker according to claim 1, further comprising: an attaching screw section of the speaker frame provided on the attaching surface, wherein the outer end portion of the edge has a wall thickness thicker than a thickness of a screw head of the attaching screw section, and a notch for preventing the attaching screw section from affecting an oscillation of the edge.

3. The loudspeaker according to claim 1, wherein the outer most periphery of the edge is located adjacently to the outer peripheral rim of the speaker frame.

4. The loudspeaker according to claim 1, wherein the edge is positioned within the speaker frame without the use of a gasket.

5. The loudspeaker according to claim 1, wherein the outer end portion of the edge to be secured on the attaching surface is located inside the outer most periphery of the edge.

* * * * *